US007926126B2

(12) United States Patent
Whitley

(10) Patent No.: US 7,926,126 B2
(45) Date of Patent: Apr. 19, 2011

(54) BATHTUB WITH TWO SECTIONS

(76) Inventor: Jeffery G. Whitley, Belleville (CA)

( * ) Notice: Subject to any disclaimer, the term of this patent is extended or adjusted under 35 U.S.C. 154(b) by 521 days.

(21) Appl. No.: 11/822,701

(22) Filed: Jul. 9, 2007

(65) Prior Publication Data

US 2009/0013460 A1 Jan. 15, 2009

(51) Int. Cl.
*A47K 3/02* (2006.01)

(52) U.S. Cl. ..... 4/555; 4/556

(58) Field of Classification Search ..... 4/555, 556, 4/560.1, 571, 578.1, 604, 579
See application file for complete search history.

(56) References Cited

U.S. PATENT DOCUMENTS 1,739,163 A * 12/1929 Mitchell ..... 4/579
2,075,933 A 4/1937 Friedlander
3,066,316 A * 12/1962 Russell ..... 4/556
3,955,219 A * 5/1976 Finch et al. ..... 4/552
3,955,221 A * 5/1976 Finch ..... 4/539
4,432,104 A * 2/1984 Sasaki ..... 4/555
4,890,341 A 1/1990 Forbes
5,184,358 A 2/1993 Gruidel
5,255,400 A * 10/1993 Sween ..... 4/556
5,341,524 A 8/1994 Zellner
5,351,345 A 10/1994 Sills
5,446,929 A 9/1995 Sills
5,813,062 A * 9/1998 Vago et al. ..... 4/556
6,766,543 B1 * 7/2004 Hollis et al. ..... 4/555

* cited by examiner

*Primary Examiner* — Khoa D Huynh

(57) ABSTRACT

The present invention relates to a bathtub comprising a tub body, said tub body comprising a bottom wall, a peripheral side wall, and a drain. The tub body comprises an upper section and a lower section attached to each other, the upper section having a bottom surface and the lower section having a top surface. The upper section and the lower section are completely detachable from each other along a detachment line between the bottom surface of the upper section and the top surface of the lower section. There is a first waterproof seal located in the peripheral side wall between the bottom surface of the upper section and the top surface of the lower section when the upper section and the lower section are attached to each other.

22 Claims, 5 Drawing Sheets

BATHTUB WITH TWO SECTIONS

SCOPE OF THE INVENTION

The present invention relates to a bathtub, and in particular, to a bathtub for handicapped and elderly persons who have difficulty using conventional bathtubs.

BACKGROUND OF THE INVENTION

Conventional bathtubs are generally constructed with high side walls in order to prevent bath water from escaping the bathtub and onto the floor. Most people are able to easily step over these high side walls when entering and exiting conventional bathtubs. However, many handicapped and elderly people have difficulty in stepping over these high side walls, and there is a substantial risk of such persons slipping and injuring themselves.

It is known to provide bathtubs that have an opening in the side wall for easier entrance and exit, such as those described in U.S. Pat. No. 2,075,933 to Friedlander and U.S. Pat. No. 4,890,341 to Forbes. When in use, a person enters such bathtubs through the opening in the side wall, the opening is closed by a door, and the bathtub is filled with bath water. When the person is finished his or her bath, the bath water is drained from the bathtub, the door is opened, and the person exits through the opening in the side wall.

It is also known to provide bathtubs that have a seat in the bathtub, in addition to an opening in the side wall. An example of such a bathtub with a seat is shown in U.S. Pat. No. 5,446,929 to Sills et al. This seat allows a handicapped or elderly person to sit more comfortably in the bathtub than if he or she was sitting on the floor of a conventional bathtub without a seat. A person sitting on the seat of such a bathtub sits at an elevated position relative to a person sitting on the floor of a conventional bathtub. Therefore, such bathtubs with a seat must be constructed to allow for a higher water line when the bathtub is filled. Specifically, such bathtubs with a seat are generally constructed with even higher side walls than conventional bathtubs The present inventor has appreciated that the above-mentioned bathtubs having an opening in the side wall, and especially such bathtubs having a seat and higher side walls, are very large in size and therefore, very difficult to transport. Many homes, retirement residences, and hospitals have obstructions, such as narrow doorways, through which it is impossible to transport these types of bathtubs. It is not uncommon to remove and reconstruct doorways in order to transport and install these types of bathtubs, thus adding substantial cost and inconvenience to the buyer.

SUMMARY OF THE INVENTION

To at least partially overcome the disadvantages of previously known bathtubs, the present invention provides a bathtub which is easier to transport and to fit through doorways.

In one aspect, the present invention provides a bathtub comprising: a tub body, said tub body comprising a bottom wall, a peripheral side wall, and a drain, wherein the tub body comprises an upper section and a lower section attached to each other, the upper section having a bottom surface and the lower section having a top surface, wherein said upper section and said lower section are completely detachable from each other along a detachment line between the bottom surface of the upper section and the top surface of the lower section, and a first waterproof seal located in the peripheral side wall between the bottom surface of the upper section and the top surface of the lower section when the upper section and the lower section are attached to each other.

In a preferred embodiment, the bathtub further comprises an opening in the side wall through which a person can enter and exit the tub body, and a door for closing the opening in the side wall, said door being movable between a closed position covering the opening and an open position uncovering the opening.

In a preferred embodiment, the upper section comprises at least 20% of a total height of the tub body. More preferably, the upper section comprises at least 40% of a total height of the tub body.

In another preferred embodiment, the upper section has a height of 36 inches or less and the lower section has a height of 36 inches or less. More preferably, the upper section has a height of 24 inches or less and the lower section has a height of 24 inches or less.

Preferably, the bathtub further comprises a seat integrally formed in the tub body, said seat comprising a back, a seat part and a kick wall, wherein a portion of the detachment line is located near the seat part. In one embodiment, an upper portion of the back of the seat is in the upper section of the tub body, and a lower portion of the back of the seat, the seat part and the kick wall are in the lower section of the tub body. In another embodiment, the back of the seat, the seat part and an upper portion of the kick wall are in the upper section of the tub body, and a lower portion of the kick wall is in the lower section of the tub body.

In one preferred embodiment, the opening in the side wall extends vertically from an upper edge of the side wall to a point near the bottom of the side wall, and wherein an upper portion of the opening is in the upper section of the tub body and a lower portion of the opening is in the lower section of the tub body.

Preferably, the opening in the side wall is a generally U-shaped opening defined by two upper sides and a lower side extending between the two upper sides, and wherein an upper portion of each upper side is in the upper section of the tub body and a lower portion of each upper side and the lower side are in the lower section of the tub body.

The door is preferably connected to the side wall by a hinge, wherein the hinge is located above the detachment line between the upper section of the tub body and the lower section of the tub body. When moving the door from the closed position to the open position, the door is moved about the hinge into a portion of the tub body inside the peripheral side wall.

The door preferably comprises a sealing member on the peripheral edge of the door, said sealing member contacting the sides of the opening in the side wall when the door is in the closed position to form a second waterproof seal, wherein said second waterproof seal extends above and below the detachment line in the tub body.

In a preferred embodiment, a support rail mounted on an inner surface of the side wall, wherein said support rail is mounted in the upper section of the tub body.

Preferably, the upper section and the lower section are attached to each other by a fastener, such as a bolt, a screw, a nail or a staple.

The bathtub further comprises a pump attached to the lower section of the tub body, wherein said pump increases the flow rate of water out of the bathtub relative to the flow rate of water out of the bathtub through the drain valve alone.

In another aspect, the present invention provides a bathtub assembly comprising: an upper section of a tub body, said upper section having a bottom surface, a lower section of a tub body, said lower section having a top surface, wherein said upper section and said lower section are completely detachable from each other along a detachment line between the bottom surface of the upper section and the top surface of the lower section, wherein said upper section and said lower section are attached to each other to form the tub body comprising a bottom wall, a peripheral side wall, and a drain, and a first waterproof seal located in the peripheral side wall between the bottom surface of the upper section and the top surface of the lower section when the upper section and the lower section are attached to each other.

When the upper section and the lower section are attached to each other, the bathtub assembly preferably comprises an opening in the side wall through which a person can enter and exit the tub body, and a door for closing the opening in the side wall, said door being movable between a closed position covering the opening and an open position uncovering the opening.

Preferably, the upper section comprises at least 20% of a total height of the tub body. Preferably, the upper section has a height of 36 inches or less and the lower section has a height of 36 inches or less.

An advantage of the bathtub of the present invention is that the bathtub comprises two smaller sections which can be entirely separated from each other, such that each section can be transported individually.

Another advantage of the bathtub of the present invention is that the bathtub can be more easily installed in a bathroom by assembling the two smaller sections to each other.

Another advantage of the bathtub of the present invention is that water does not leak along the line where the two smaller sections are attached to each other when the bathtub is filled with water.

BRIEF DESCRIPTION OF THE DRAWINGS

Further aspects and advantages will become apparent from the following description taken together with the accompanying drawings.

Throughout all the drawings in the disclosure, similar parts are indicated by the same reference numerals.

DETAILED DESCRIPTION OF THE PREFERRED EMBODIMENT

Reference is made to FIGS. 1 to 6 which show a preferred embodiment of the present invention.

The present invention is a bathtub 10 having a tub body 12. The tub body 12 is made from acrylic, fibreglass, porcelain or any other durable rigid material.

Figure 2:
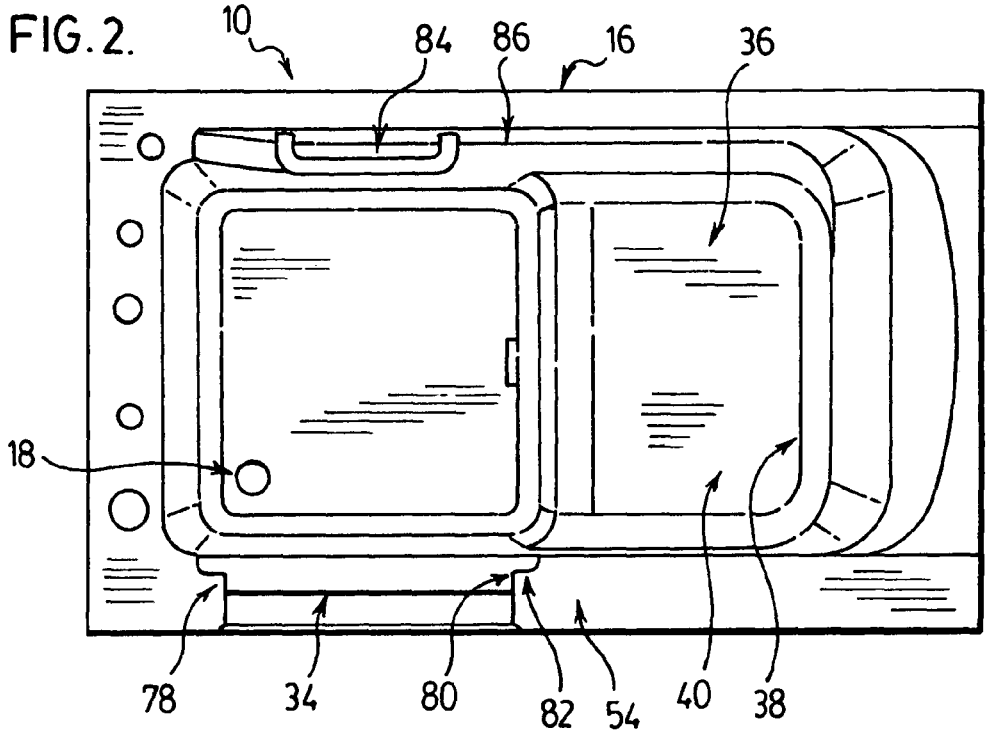
FIG. 2 is a top view of the bathtub shown in FIG. 1.
Figure 3:
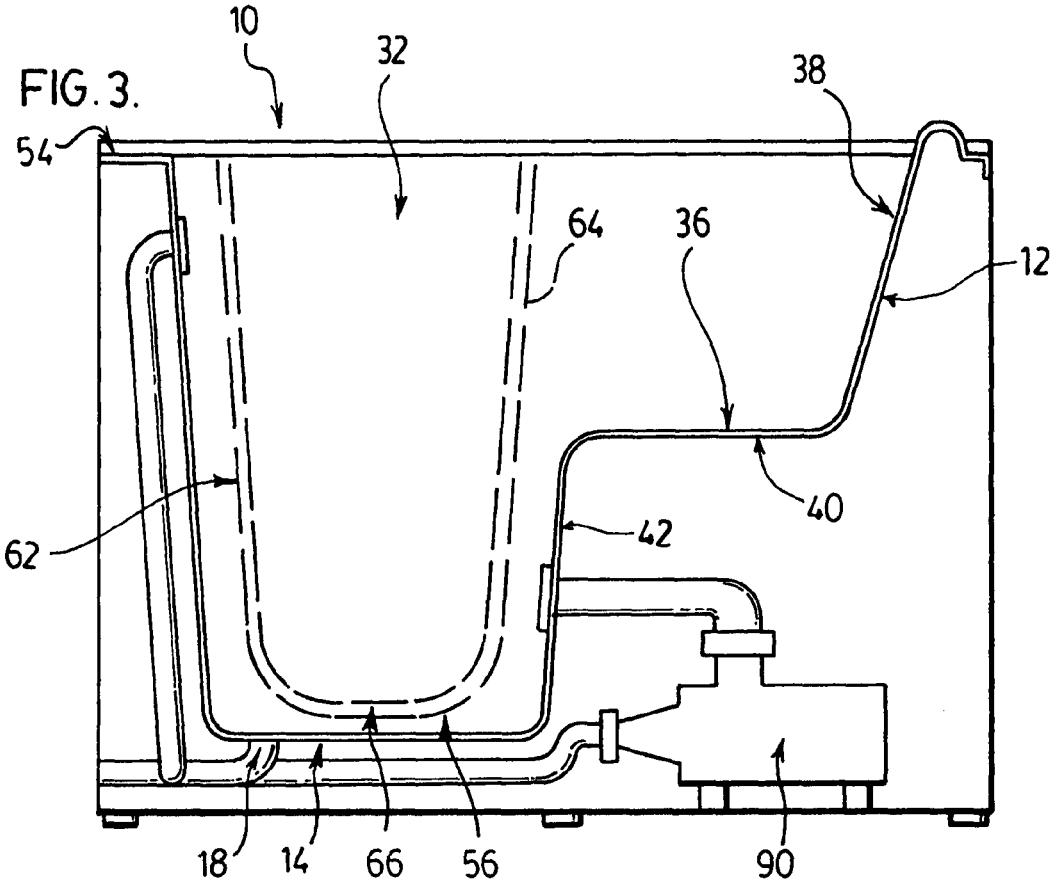
FIG. 3 is a cross-sectional view of the bathtub shown in FIG. 2 across section line 2-2.
Figure 4:
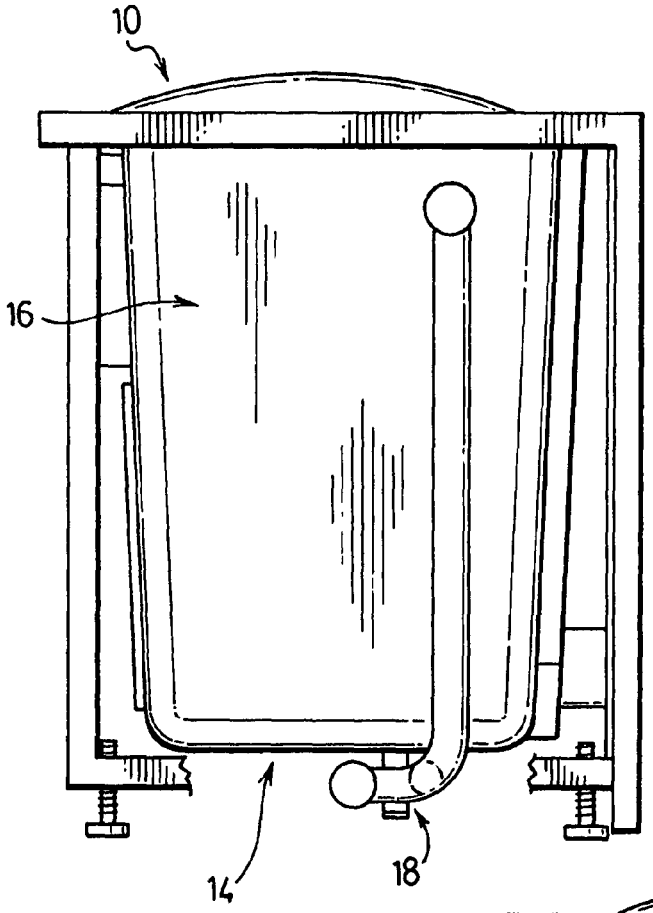
FIG. 4 is a front view of the bathtub shown in FIG. 1.

As shown in FIGS. 2 and 3, the tub body 12 has a bottom wall 14 and a peripheral side wall 16. When in use, a person enters the tub body 12 and fills the tub body 12 with water. The tub body 12 is filled to any desired capacity, as long as the water line does not rise above the upper edge 54 of the peripheral side wall 16, or else water could escape from the bathtub 10 and onto the floor. When the person is finished his or her bath, the bath water is drained from the tub body 12 through a drain 18 which is located in the bottom wall 14.

Figure 6:
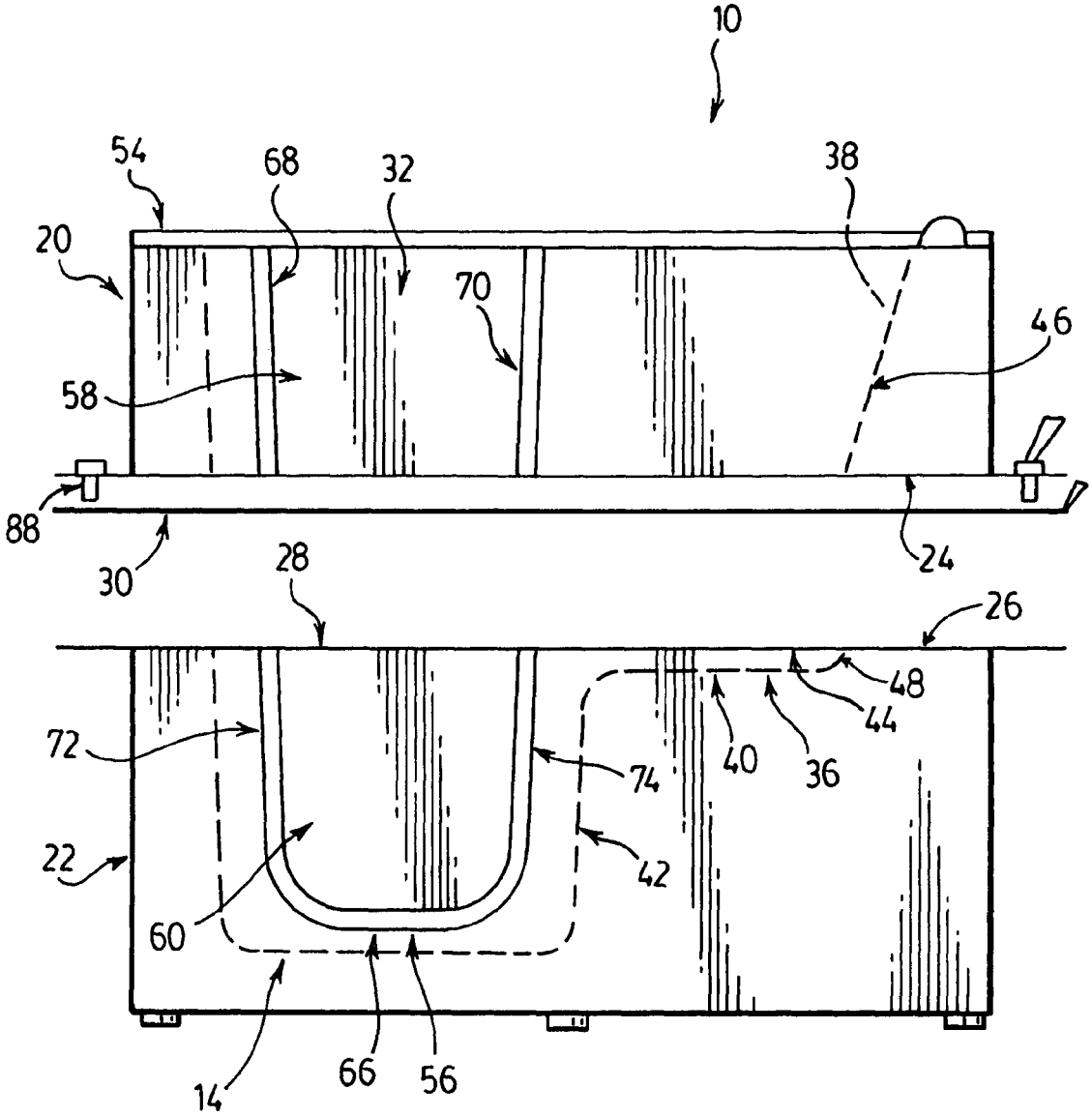
FIG. 6 is a cross-sectional view of the bathtub shown in FIG. 2 across section line 2-2, where the upper section and the lower section are entirely detached from each other.

As illustrated in FIG. 6, the tub body 12 is made up of two sections, an upper section 20 and a lower section 22, which can be attached to each other and also detached from each other. The upper section 20 has a bottom surface 24. The lower section 22 has a top surface 26.

Figure 1:
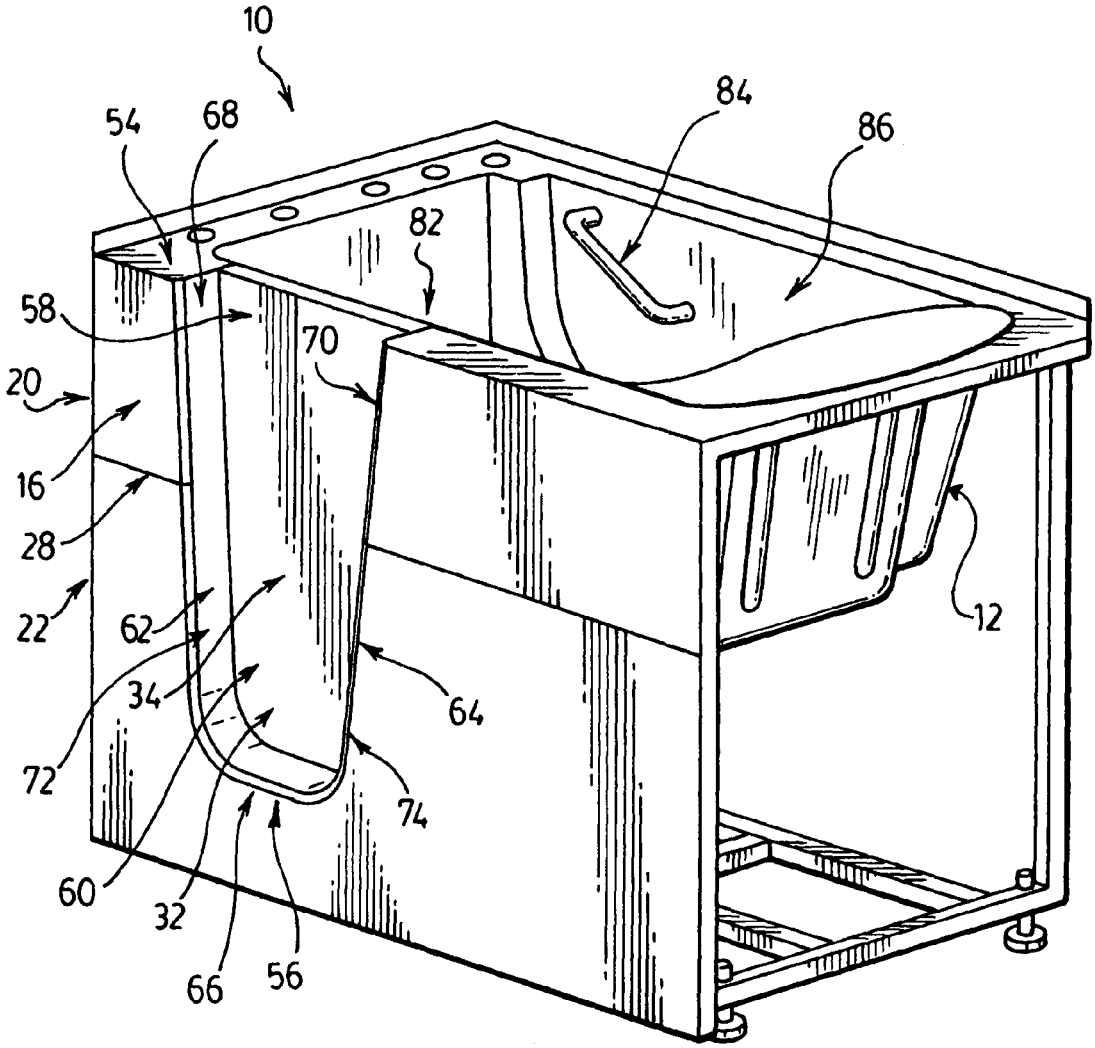
FIG. 1 is a perspective view of a bathtub in accordance with a preferred embodiment of the present invention.

In FIG. 1, the upper section 20 and the lower section 22 are attached to each other. There is a detachment line 28 between the bottom surface 24 of the upper section 20 and the top surface 26 of the lower section 22. The upper section 20 and the lower section 22 are completely detachable from each other along the detachment line 28, as can be seen in FIG. 6.

In order to prevent bath water from leaking through the detachment line 28 when the upper section 20 and the lower section 22 are attached to each other, a first waterproof seal 30 is located in the peripheral side wall 16 between the bottom surface 24 of the upper section 20 and the top surface 26 of the lower section 22. The first waterproof seal 30 is shown in FIG. 6 where the upper section 20 and the lower section 22 are detached from each other. The first waterproof seal 30 may be made of neoprene rubber in a preferred embodiment.

A fastener 88 is used to securely attach the upper section 20 and the lower section 22 to each other. The fastener 88 may be a bolt, a screw, a nail or a staple.

When the upper section 20 and the lower section 22 are attached to each other, they form the tub body 12 having a total height. Preferably, the upper section 20 comprises at least 20% of the total height of the tub body 12. More preferably, the upper section 20 comprises at least 40% of the total height of the tub body 12.

Preferably, the upper section 20 has a height of 36 inches or less and the lower section 22 has a height of 36 inches or less. More preferably, the upper section 20 has a height of 24 inches or less and the lower section 22 has a height of 24 inches or less.

In the preferred embodiment, the bathtub 10 has an opening 32 in the side wall 16 through which a person can exit and enter the bathtub 12. The opening 32, as shown in FIGS. 1 and 3, extends vertically from an upper edge 54 of the side wall 16 to a point 56 near the bottom of the side wall 16. The opening 32 in the side wall 16 is a generally U-shaped opening defined by two upper sides 62, 64 and a lower side 66 extending between the two upper sides 62, 64. Upper portions 68, 70 of the two upper sides 62, 64 are in the upper section 20 of the tub body 12. Lower portions 72, 74 of the two upper sides 62, 64 and the lower side 66 are in the lower section 22 of the tub body 12. This opening 32 in the side wall 16 allows the person to easily enter and exit the tub body 12 without having to step over high side walls.

A door 34 is movable between a closed position covering the opening 32, as shown in FIG. 1, and an open position uncovering the opening 32. The door 34 may be connected to the side wall 16 by a hinge which is located above the detachment line 28 between the upper section 20 and the lower section 22.

In order to prevent bath water from leaking through a space between the door 34 and the sides 62, 64, 66 of the opening 32, a sealing member 78 on the peripheral edge 80 of the door 34 is used. The sealing member 78 contacts the two upper sides 62, 64 and the lower side 66 of the opening 32 when the door 34 is in the closed position. This forms a second waterproof seal 82 which extends above and below the detachment line 28 in the tub body 12.

The bathtub 10 also has a seat 36 integrally formed in the tub body 12, as illustrated in FIG. 3. The seat 36 has a back 38, a seat part 40 and a kick wall 42. A portion 44 of the detachment line 28 is located near the seat part 40. The seat 36 allows a person to sit comfortably in the bathtub 10 while taking a bath.

As can be seen in FIG. 6, an upper portion 46 of the back 38 of the seat 36 is in the upper section 20 of the tub body 12. A lower portion 48 of the back 38 of the seat 36, the seat part 40 and the kick wall 42 are all in the lower section 22 of the tub body 12.

As illustrated in FIGS. 1 and 2, a support rail 84 is mounted on an inner surface 86 of the side wall 16. The support rail 84 is mounted in the upper section 20 of the tub body 12. The support rail 84 is useful for handicapped or elderly people who may have difficulty in standing up after being seated on the seat 36.

Figure 5:
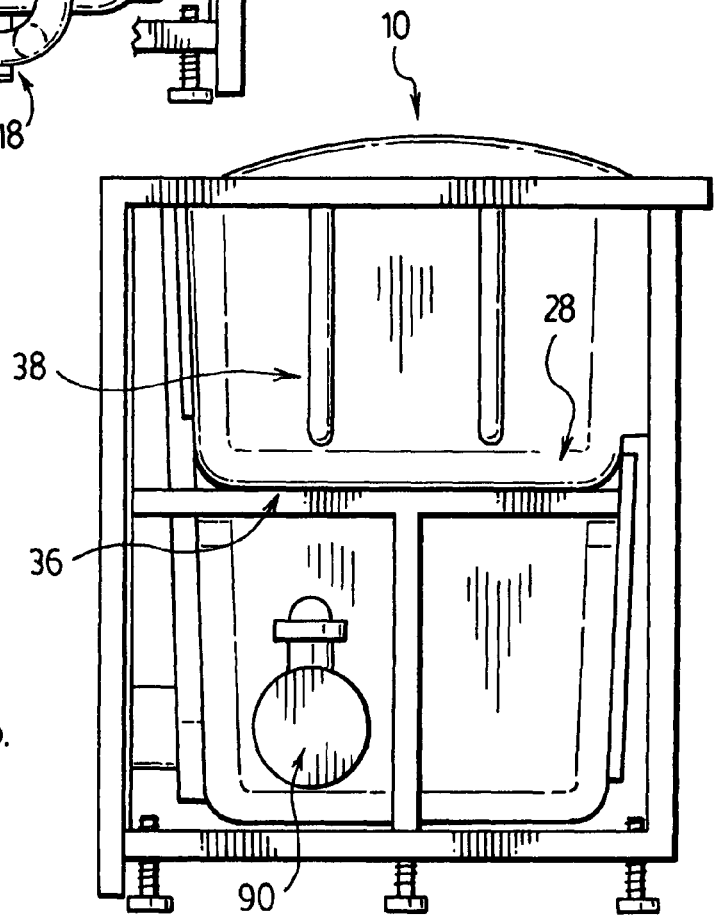
FIG. 5 is a rear view of the bathtub shown in FIG. 1.

FIGS. 3 and 5 illustrate a pump 90 which is attached to the lower section 22 of the tub body 12. The pump 90 can be used to facilitate the flow of water out of the bathtub 10 after the person has finished his or her bath. When the pump 90 is used, the flow rate of water out of the bathtub 10 is greater than the flow rate of water out of the bathtub 10 through the drain 18 alone.

In an alternative embodiment of the bathtub of the present invention, there is neither an opening in the side wall nor a door for covering an opening.

In another alternative embodiment, the bathtub does not have a seat formed in the tub body.

Figure 7:
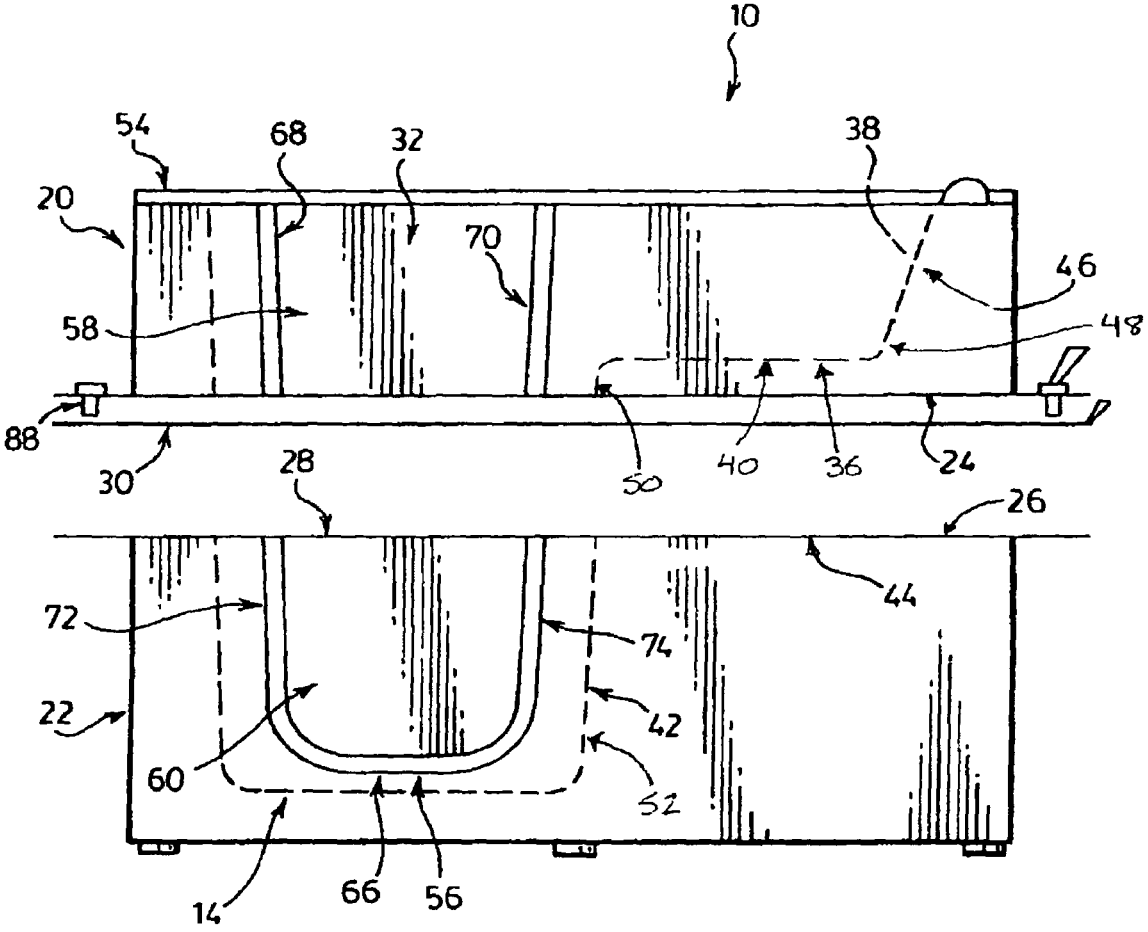
FIG. 7 is a cross-sectional view of the bathtub in accordance with an alternate embodiment of the present invention, where the upper section and the lower section are entirely detached from each other.

In another alternative embodiment, as illustrated in FIG. 7 the entire back 38 of the seat 36, the seat part 40 and an upper portion 50 of the kick wall 42 are all in the upper section 20 of the tub body 12, while a lower portion 52 of the kick wall 42 is in the lower section 22 of the tub body 12.

Advantageously, the upper section 20 and the lower section 22 can be entirely detached from each other along the detachment line 28, such that each section can be transported individually. The individual sections 20, 22 are smaller than the tub body 12 as a whole, and therefore, much easier to transport and fit through narrow doorways. The bathtub 10 can also be more easily installed in a bathroom by assembling the upper section 20 and the lower section 22 to each other.

Another advantage of the bathtub 10 is that water does not leak out along the detachment line 28 when the upper section 20 and the lower section 22 are attached to each other when the tub body 12 is filled with water because the first waterproof seal 30 prevents such leakage.

The present invention is also directed to a bathtub assembly which comprises the upper section 20 of the tub body 12 and the lower section 22 of the tub body 12. To assemble the tub body 12, the upper section 20 and the lower section 22 are attached to each other along detachment line 28 between the bottom surface 24 of the upper section 20 and the top surface 26 of the lower section 22. A first waterproof seal 30 is located in the peripheral side wall 16 between the bottom surface 24 of the upper section 20 and the top surface 26 of the lower section 22 in order to prevent water from leaking at the detachment line 28.

Although this disclosure has described and illustrated a preferred embodiment of the invention, it is to be understood that the invention is not restricted to this particular embodiment. Rather, the invention includes all embodiments that are functional or mechanical equivalents of the specific embodiments in features that have been described and illustrated herein. Many modifications and variations will now occur to those skilled in the art. For a definition of the invention, reference is made to the following claims.

I claim:

1. A bathtub comprising:

a tub body, said tub body comprising a bottom wall, a peripheral side wall, and a drain, wherein the tub body comprises an upper section and a lower section, and fasteners for securely attaching the upper section to the lower section, the upper section having a bottom surface and the lower section having a top, surface, wherein said upper section and said lower section are completely detached from each other along a detachment line between the bottom surface of the upper section and the top surface of the lower section during transportation and assembly, and, the fasteners securely attach the bottom surface of the upper section and the top surface of the lower section after assembly, wherein the upper section and the lower section are smaller than the tub body to allow for transport and assembly, and a first waterproof seal located in the peripheral side wall between the bottom surface of the upper section and the top surface of the lower section when the upper section and the lower section are securely attached to each other.

2. The bathtub of claim 1, further comprising an opening in the side wall through which a person can enter and exit the tub body, and a door for closing the opening in the side wall, said door being movable between a closed position covering the opening and an open position uncovering the opening.

3. The bathtub of claim 1, wherein the upper section comprises at least 20% of a total height of the tub body.

4. The bathtub of claim 1, wherein the upper section comprises at least 40% of a total height of the tub body.

5. The bathtub of claim 1, wherein each of the upper section and the lower section can individually fit through a doorway.

6. The bathtub of claim 5, wherein the upper section has a height of 36 inches or less and the lower section has a height of 36 inches or less.

7. The bathtub of claim 5, wherein the upper section has a height of 24 inches or less and the lower section has a height of 24 inches or less.

8. The bathtub of claim 1, further comprising a seat integrally formed in the tub body, said seat comprising a back, a seat part and a kick wall, wherein a portion of the detachment line is located near the seat part.

9. The bathtub of claim 8, wherein an upper portion of the back of the seat is in the upper section of the tub body, and a lower portion of the back of the seat, the seat part and the kick wall are in the lower section of the tub body.

10. The bathtub of claim 8, wherein the back of the seat, the seat part and an upper portion of the kick wall are in the upper section of the tub body, and a lower portion of the kick wall is in the lower section of the tub body.

11. The bathtub of claim 2, wherein the opening in the side wall extends vertically from an upper edge of the side wall to a point near the bottom of the side wall, and wherein an upper portion of the opening is in the upper section of the tub body and a lower portion of the opening is in the lower section of the tub body.

12. The bathtub of claim 2, wherein the opening in the side wall is a generally U-shaped opening defined by two upper sides and a lower side extending between the two upper sides, and wherein an upper portion of each upper side is in the upper section of the tub body and a lower portion of each upper side and the lower side are in the lower section of the tub body.

13. The bathtub of claim 2, wherein the door is connected to the side wall by a hinge, and wherein the hinge is located above the detachment line between the upper section of the tub body and the lower section of the tub body.

14. The bathtub of claim 2, further comprising a sealing member on the peripheral edge of the door, said sealing member contacting the sides of the opening in the side wall when the door is in the closed position to form a second waterproof seal, wherein said second waterproof seal extends above and below the detachment line in the tub body.

15. The bathtub of claim 1, further comprising a support rail mounted on an inner surface of the side wall, wherein said support rail is mounted in the upper section of the tub body.

16. The bathtub of claim 1, wherein the fasteners are selected from the group consisting of a bolt, a screw, a nail and a staple.

17. The bathtub of claim 1, further comprising a pump attached to the lower section of the tub body, wherein said pump increases the flow rate of water out of the bathtub relative to the flow rate of water out of the bathtub through the drain alone.

18. A bathtub assembly comprising:

an upper section of a tub body, said upper section having a bottom surface, a lower section of a tub body, said lower section having a top surface, fasteners for securely attaching the upper section to the lower section;

wherein said upper section and said lower section are completely detached from each other along a detachment line between the bottom surface of the upper section and the top surface of the lower section during transportation and assembly, and, the fasteners securely attach the bottom surface of the upper section and the top surface of the lower section after assembly, wherein said upper section and said lower section are securely attached to each other to form the tub body comprising a bottom wall, a peripheral side wall, and a drain, wherein the upper section and the lower section are smaller than the tub body to facilitate transport and assembly, and a first waterproof seal located in the peripheral side wall between the bottom surface of the upper section and the top surface of the lower section when the upper section and the lower section are securely attached to each other.

19. The bathtub assembly of claim 18, wherein each of the upper section and the lower section can individually fit through a doorway.

20. The bathtub assembly of claim 19, wherein the upper section has a height of 36 inches or less and the lower section has a height of 36 inches or less.

21. The bathtub assembly of claim 18, wherein when the upper section and the lower section are securely attached to each other, said bathtub assembly further comprises an opening in the side wall through which a person can enter and exit the tub body, and a door for closing the opening in the side wall, said door being movable between a closed position covering the opening and an open position uncovering the opening.

22. The bathtub assembly of claim 18, wherein the upper section comprises at least 20% of a total height of the tub body.

* * * * *